United States Patent [19]

Blust

[11] Patent Number: 4,921,177

[45] Date of Patent: May 1, 1990

[54] STRING POSITIONING DEVICE AND METHOD

[75] Inventor: Dale K. Blust, Atco, N.J.

[73] Assignee: Figgie International Inc., Willoughby, Ohio

[21] Appl. No.: 259,529

[22] Filed: Oct. 18, 1988

[51] Int. Cl.[5] ..... B65H 54/64

[52] U.S. Cl. ..... 242/3; 226/91; 226/97

[58] Field of Search ..... 242/2, 3, 18 A; 226/91, 226/97

[56] References Cited

U.S. PATENT DOCUMENTS

| | | | |
|---|---|---|---|
| 2,060,430 | 11/1936 | Spooner | 226/97 X |
| 2,630,772 | 3/1953 | Ederer | 112/2 |
| 2,919,970 | 1/1960 | Russell | 226/97 X |
| 3,075,714 | 1/1963 | Perraut | 242/18 A |
| 3,389,679 | 6/1968 | Weber et al. | 118/8 |
| 3,476,003 | 11/1969 | Adams | 83/357 |
| 3,521,826 | 7/1970 | Schmick | 242/18 A |
| 3,636,898 | 1/1972 | Conner, Jr. | 112/203 |
| 3,712,609 | 1/1973 | Robert | 271/74 |
| 3,825,250 | 7/1974 | Miller | 271/59 |
| 3,999,695 | 12/1976 | Bradley | 226/91 X |
| 4,343,254 | 8/1982 | Takatori | 112/262.2 |
| 4,666,094 | 5/1987 | Rockerath | 242/7.02 |

*Primary Examiner*—Katherine A. Matecki

*Attorney, Agent, or Firm*—Thomas A. Lennox

[57] ABSTRACT

A string positioning device to attach strings on a core to wind baseballs includes a holding device to hold an end of the string leaving a free end free with a head member with a face facing in the general direction that the string is to be positioned along a directional line with a plurality of pairs of holes all angled to focus on points along the directional line with a compressed air supply to cause air to flow outwardly through the holes to catch and hold a length of the free end of the string in alignment along the directional line.

24 Claims, 4 Drawing Sheets

STRING POSITIONING DEVICE AND METHOD

BACKGROUND OF THE INVENTION

This invention involves positioning of an attachment of string to an object. More specifically, this invention involves the attachment of the string to a ball core for the winding of baseballs.

In the construction of baseballs, there are separate winding steps wherein different grades of string are wound on a resilient rubber core. A ball winding apparatus is described and illustrated in U.S. Pat. No. 4,666,084 to John L. Rockerath incorporated herein by reference thereto. FIG. 1 illustrates the ball winding apparatus having a station which when combined with similar apparatuses provides the multiple stations necessary to wind the official baseball. This invention involves the attachment of the string to the core or to partially wound cores in the winding process. A prior method includes dipping the core in a tacky adhesive followed by a person hand winding the string around the resilient rubber core sufficiently to insure that the string gets started in the winding process once the apparatus in FIG. 1 was started. The string may fail to stay on that initial wind causing the string to gather in uneven areas or simply not be dragged onto the spinning core at all. This necessitates stopping the machine including the other winds which are now partially completed. Such a failure to engage the string on a core would insure that the other ball being wound on a second wind was wound longer and thus would probably be out of specification. Further, the use of hand labor to attach the string is messy and introduces inconsistencies, errors and a significant safety hazard to the operator.

Various types of string positionings and attachment are described in the prior art but none satisfy the needs illustrated above nor attain the objects listed hereinbelow.

SUMMARY OF THE INVENTION

It is an object of the present invention to provide a device and method to position the end of a string in relation to a chosen surface accurately and reliably in a continuous process.

It is an object of the present invention to provide a device and method for attaching string or like material to a body.

It is a further object of the present invention to attach string to a rubber ball to eliminate the need for adhesive and hand attachment of the string prior to winding string around the ball.

Throughout the specification and claims, the term "string" is used without any intention to limit the breadth of the specification or claims. The term "string" is intended to include monofilament, cord, woven and braided materials and includes any composition including natural and synthetic fibers, metal, rubber and like materials and may be of any shape including round, tubular, or others.

The invention is a string positioning device to position a free end of a string in alignment with a directional line. The device includes a string holding means to hold the string with the free end of the string positioned proximate the directional line, and a string end positioning means. The string positioning means includes a head member having a wall facing along the directional line with a plurality of holes through the wall spaced apart from each other. The device also includes a compressed air supply means to supply compressed air to the head member to flow outwardly through the holes. The holes are spaced sufficiently apart and the holes are angled sufficiently into the wall to cause the air flow out of the holes to focus at at least one point on the directional line to catch and hold a length of the free end in alignment along the directional line.

It is preferred that the directional line be proximate a surface and that the surface be a round convex surface. It is more preferred that the surface be a spherical surface. It is preferred that the holes be in a plane containing the directional line, and that the holes be spaced apart in pairs, the holes of each pair equidistant from the directional line. It is preferred that there be no holes proximate to the directional line. It is preferred that there be a plurality of pairs of holes and the pair of holes closest to the directional line are of a smaller diameter than a pair of holes further from the directional line. It is also preferred that the combined area of the holes is smaller that the area of an air source opening into the head member through which the supply of compressed air flows to the head member. It is also preferred that the wall has two to six holes grouped apart in equal numbers on each side of the directional line. It is also preferred that the holes are angled such that lines drawn through the center of the holes focus about two to about four inches from the wall along the directional line.

The invention is preferably a string attaching device to attach a string to a body having a round convex surface. The device includes a rotating means to rotate the body by contact with the round convex surface and a body holding means to hold the body with a portion of the round convex surface facing the rotating means. The device further includes a string holding means to hold the string with a free end of the string positioned proximate the body and a string end positioning means, the latter including at least one wall or head member attached proximate the body holding means with a plurality of holes in groups spaced apart from each other in the head member. The string end positioning means also includes a compressed air supply means to supply compressed air to the head member to flow outwardly through the holes. The head member and the holes are positioned, and the holes are angled sufficiently into the head member to cause the air flow out of the holes to focus in an area sufficient to hold a length of the free end of the string close to the portion of the round convex surface. It is preferred that the holding means include a pair of freely rotating concave rollers, and that the rotating means include a horizontal rotating drum.

A preferred embodiment of the invention is in a ball winding apparatus having at least one winding station at which string is wound around a core. The station includes support means to hold the core during the winding and rotating means to hold by contact with the surface of the core and the winding ball. The invention includes a string attaching device that includes a string holding means to hold the string with a free end of the string positioned proximate the core and a string end positioning means. The string end positioning means includes at least one head member attached proximate the core support means with a plurality of holes, preferably in two groups spaced apart from each other in the head member. The string end positioning means includes a compressed air supply means to supply compressed air to the head member to flow outwardly through the holes. The head member and the holes are positioned, and the holes are angled sufficiently into the head member to cause the air flow out of the holes to focus in a directional line from the head member to a space between the core and the rotating means sufficient to hold a length of the free end of the string close to the core.

The invention is a method of positioning string to a surface including holding the string with a free end of the string positioned proximate the surface. The method further includes holding at least one head member having a face member facing in a direction generally tangential to but not at the surface, the face member having a plurality of holes spaced apart from each other through the face member. The method further includes flowing compressed air to the face member to flow outwardly through the holes. The holes are spaced sufficiently apart and the holes are angled sufficiently into the face member to cause the air flow out of the holes to converge in a constricted area. The method further includes catching and holding with the air flow a length of the free end of the string close to a tangential position with the surface.

A preferred embodiment of the invention is a method of attaching string to a body having a round convex surface including providing rotating means to rotate the body by contact with the round convex surface. The method further includes holding the body with the round convex surface facing the rotating means while exposing a top of the body and holding a free end of the string proximate the body. The method further includes providing a string end positioning means including at least one head member with a plurality of holes in two groups spaced from each other in the head member. The method further includes blowing air outwardly through the holes. The method further includes positioning the head member and the holes, and angling the holes sufficiently into the head member causing the air flow out of the two groups of holes to converge in a constricted area sufficient to hold a length of the free end of the string close to the top of the body. The method further includes moving the body against the rotating means catching the length of the string end between the body and the rotating means, and the rotating means to wind the string around the body.

BRIEF DESCRIPTIONS OF THE DRAWINGS

FIG. 1 is a perspective view of a ball winding device similar to that illustrated and described in U.S. Pat. No. 4,666,094.

DESCRIPTION OF THE PREFERRED EMBODIMENTS

Figure 1:
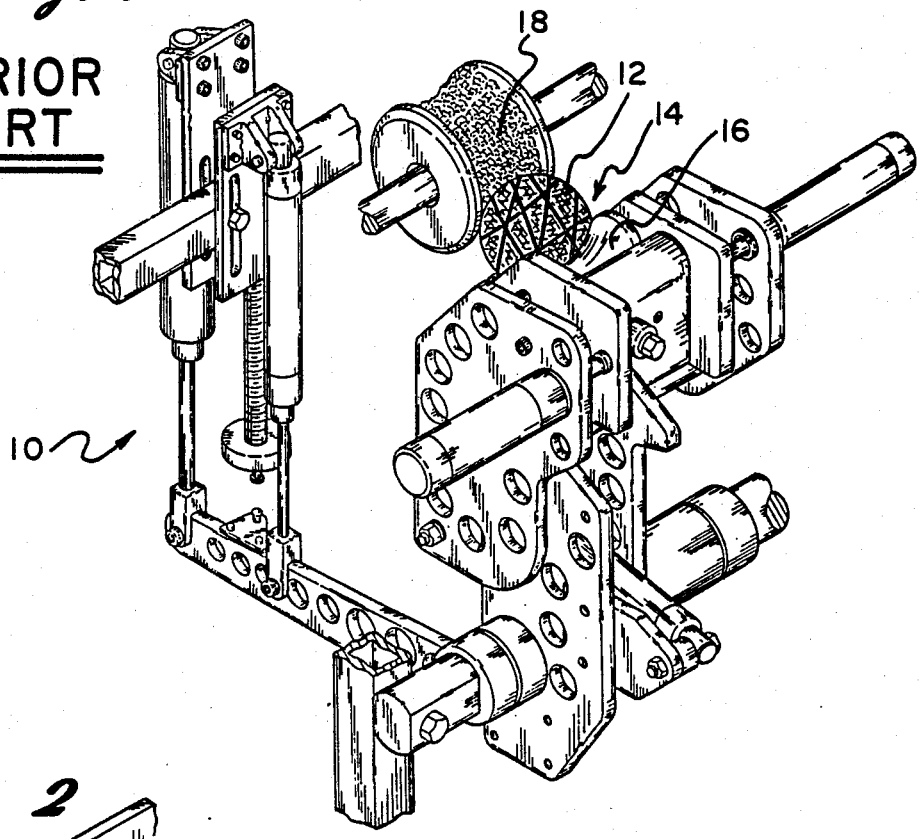
Fig. 1 PRIOR ART

FIG. 1 illustrates ball winding apparatus 10 as described in U.S. Pat. No. 4,666,094 to John L. Rockerath. Ball 12 is wound at station 14 identified by rollers 16 which are moved to place ball 12 against driven wobbler rotating device 18. At station 14, string is wound around a resilient rubber and cork core to start the winding. Without the hand winding around the core, the core fails to pick up the string and winding does not take place effectively.

Figure 2:
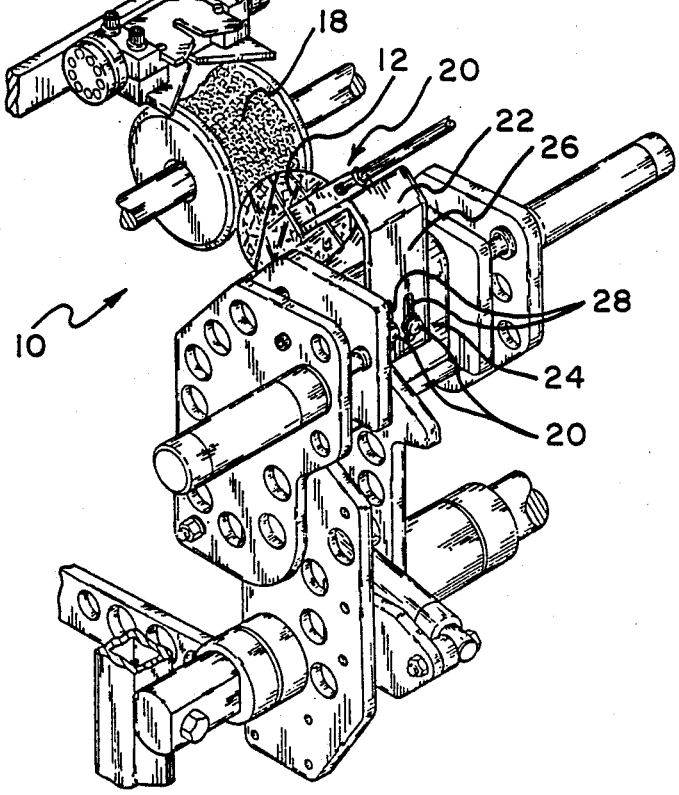
FIG. 2 is a perspective view of the winding device with a string positioning and attachment device of the present invention added.

In FIG. 2, string positioning device 20 has been added supported on bracket 22 which is generally an acute angled "L" shaped bracket attached to support member 24, which is part of the movement mechanism that rotates to place ball 12 against wobbler 18 in the winding process. Vertical leg 26 includes slots 28 through which bolts 30 adjustably attach bracket 22 to support 24. This allows vertical adjustment and positioning of device 20 which is attached to the opposite end of bracket 22.

Figure 3:
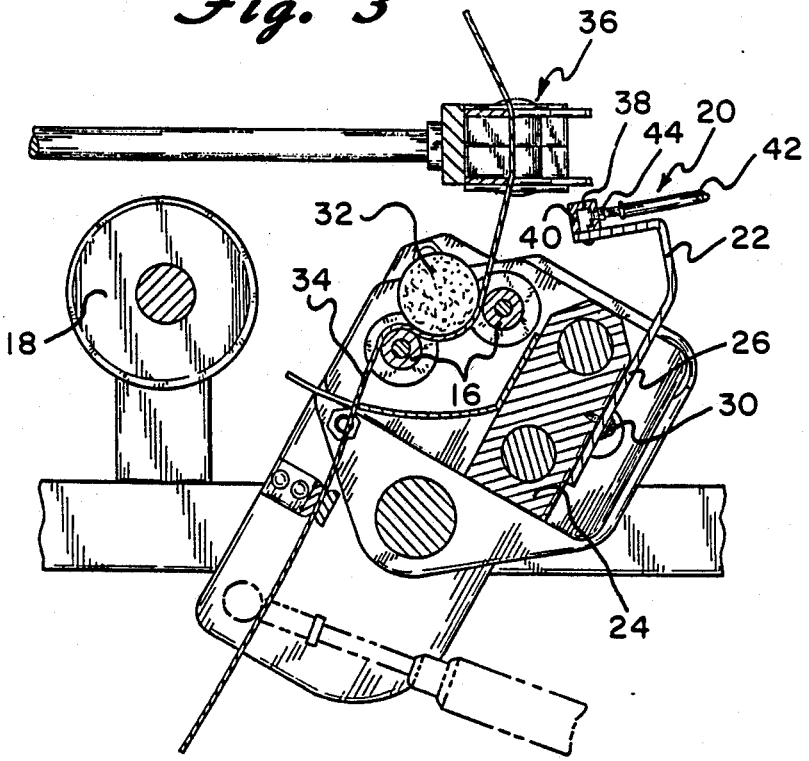
FIG. 3 is a cross-sectional view taken along 3—3 of FIG. 2, just before the positioning device is operated.

In the cross sectional view of FIG. 3, the rotating ball movement mechanism including support member 24 is rotated away from wobbler 18 at the beginning of the winding cycle. Baseball core 32 has been placed on free spinning roller 16 trapping the end of string 34 which is draped over the rollers. String 34 has been positioned by holder and cutter member 36 which has cut the string and is holding the end positioning it over the rollers prior to positioning core 32 at that station. Positioning device 20 includes head member 38 which includes face 40 facing generally in the direction in which the string is to be positioned. Compressed air is provided through tube 42 attached to head member 38 with fitting 44 opening to an interior chamber in head member 38.

Figure 4:
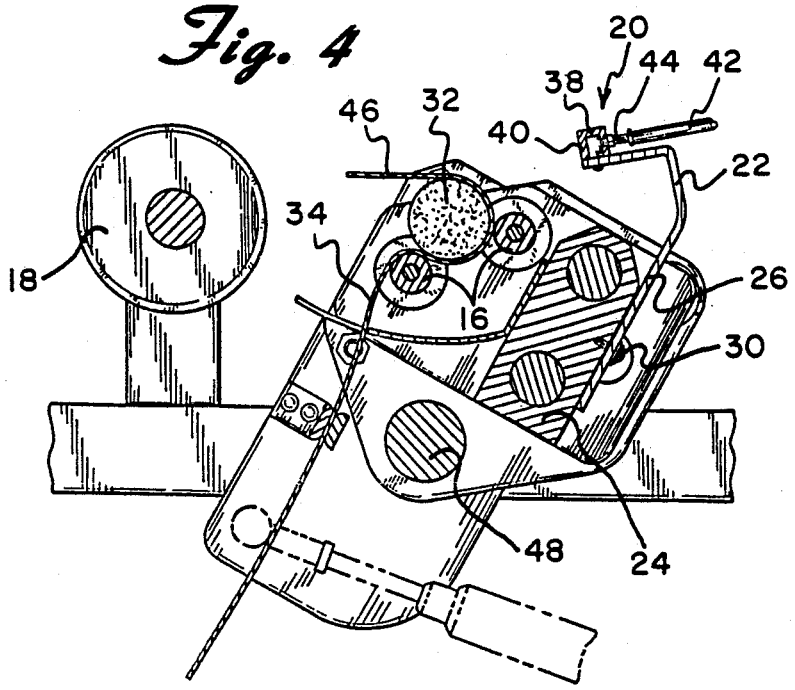
FIG. 4 is cross-sectional view similar to that of FIG. 3 with the string positioning device implemented.
Figure 5:
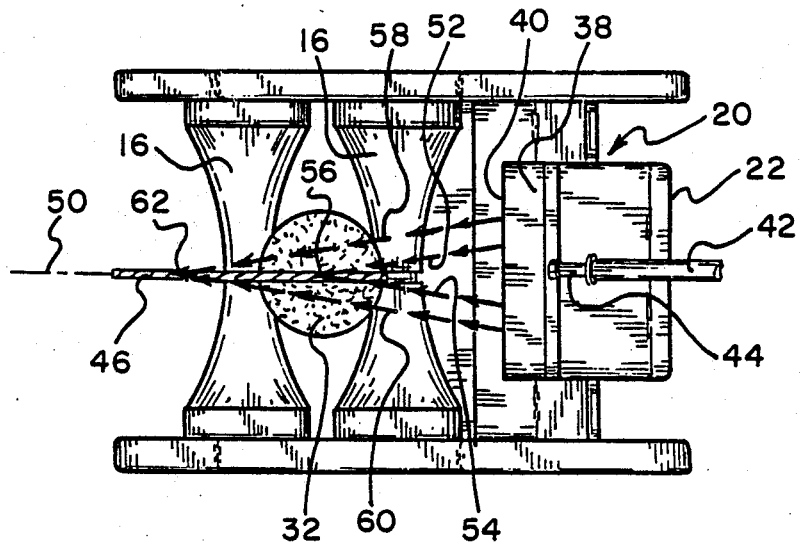
FIG. 5 is a partial top view of the device in FIG. 2 with a diagram of air flow implementing the string positioning device operating as in FIG. 4.

In FIG. 4, string end 46 has been released and by the action of positioning device 20 has now been positioned ready to be wound on the surface of ball core 32. In the next step, not pictured, the ball movement device rotates on horizontal rod 48 bringing the surface of core 32 against wobbler 18 trapping string end 46 between the two surfaces. The wobbler begins spinning rotating the ball and winding string 34 onto core 32. In FIG. 5, looking from above, string end 46 has been positioned by device 20 close to the upper surface of ball core 32 generally in a directional line 50 which extends back to face 40 of head member 38. The arrows indicate air flow from face 40 directed at points on directional line 50. The air flow is from holes in face 40 angled such that the air flow is directed to points along line 50. The holes are positioned in pairs equidistant from the intersection of line 50 with face 40. Directional line 50 is generally tangential to the surface of ball core 32, in this case about $\frac{1}{8}$ of an inch above the surface of core 32. In this embodiment, there are two pairs of holes. An inside pair provide air jets along directions 52 and 54 both pointing to and focused at point 56 along line 50 generally closest to the surface of ball core 32. Outside holes, further from the point of intersection of line 50 with face 40 provide air flow directions 58 and 60 which are angled to intersect and be focused on point 62 further away from face 40 along line 50. Points 56 and 62 are about $2\frac{1}{2}$ and 3 inches away from face 40, respectively, although these focus points could be a good deal further away from the air source.

Figure 6:
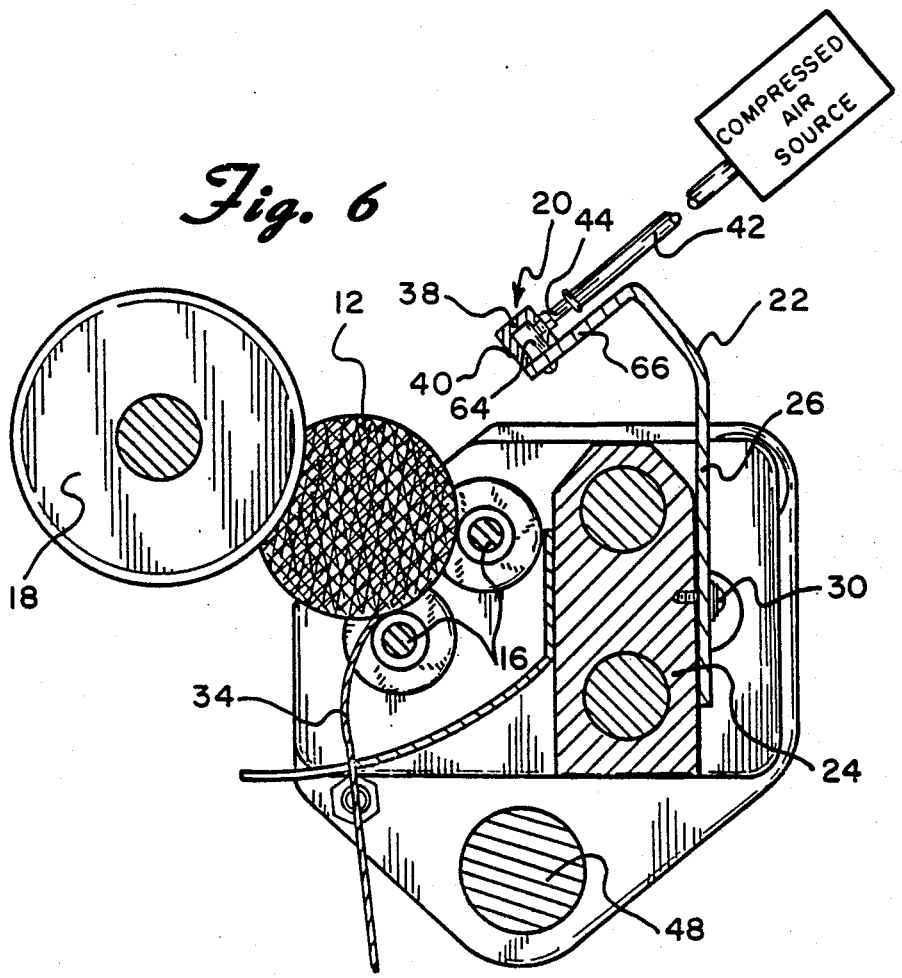
FIG. 6 is an enlarged partial cross-sectional view of the device of FIG. 4 with the winding device moved to the winding position as in FIG. 2.

In FIG. 6, ball 12 has been wound by wobbler 18 spinning the core and the string wound ball on rollers 16. In this view, chamber 64 is shown inside head member 38 opening to fitting 44 and compressed air tube 42 such that compressed air is supplied to chamber 64 to exit through holes in face 40. In this view, upper arm 66 of bracket 22 is best illustrated angled downwardly toward ball 12 to position head member 38 and specifically face 40 facing the directional line desired for positioning the end of string 34 between core 32 and wobbler 18.

Figure 7:
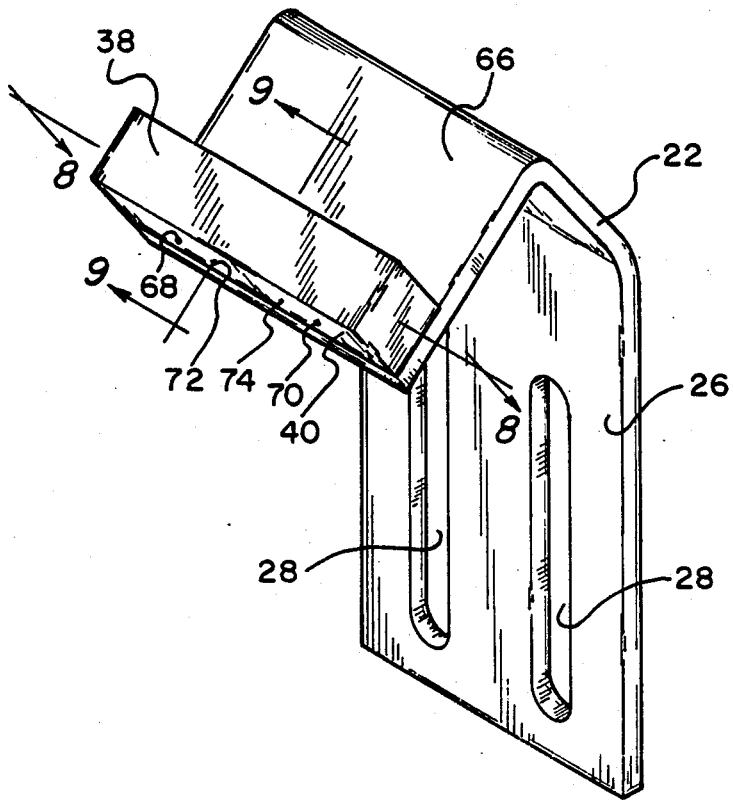
FIG. 7 is a perspective view of the positioning device.

The expanded view of FIG. 7 illustrates the shape and position of support bracket 22 in relation to head member 38 with face 40 through which holes 68, 70, 72 and 74 are cut. Holes pair 68 and 70 are angled to focus on a single point while hole pair 72 and 74 are closer to but on both sides of the center of face 40 are directed to focus at a second point along the directional line. Holes 68 and 70 are each about 0.028 inch diameter and holes 72 and 74 are each about 0.020 inch diameter. It is preferred that the diameter of the holes be in the range of about 0.015 to 0.050 inch diameter, and more preferably 0.015 to 0.035 inch. As the hole sizes increase, substantially greater pressures are required. As the hole size reaches about 0.06 inch, the pressure requirement is unnecessarily high. Slots 28 allow the bolts to adjustably fix bracket 22 at various heights to adjust the position and direction of face 40.

Figure 9:
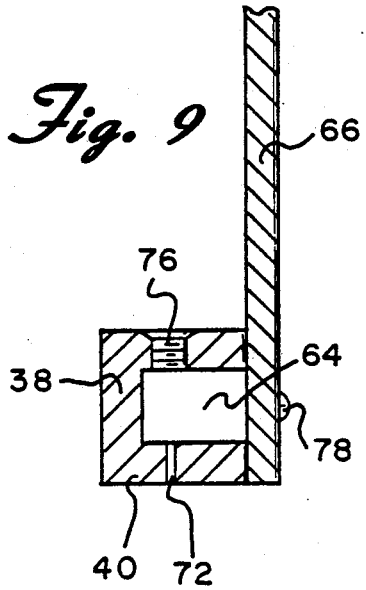
FIG. 9 is a cross-sectional view taken along lines 9—9 of FIG. 7.
Figure 8:
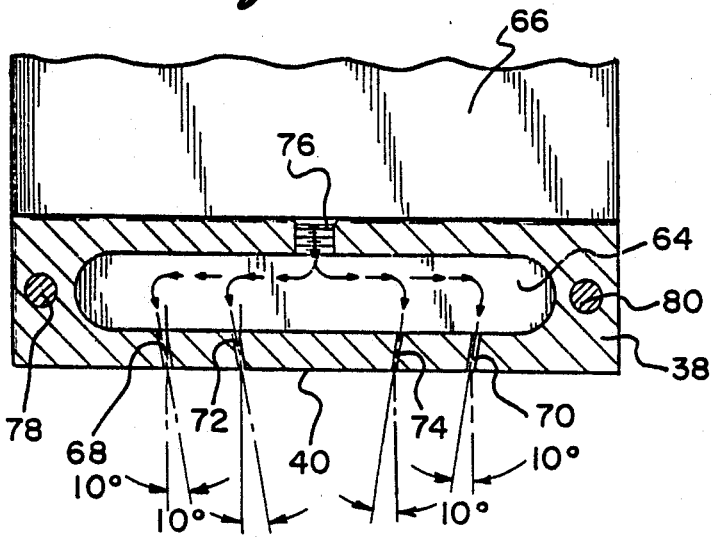
FIG. 8 is a cross-sectional view taken along lines 8—8 of FIG. 7.

In FIG. 8, this horizontal view shows chamber 64 receiving air through threaded hole 76 in which fitting 44 is threadably connected to provide compressed air at 80 to 100 psi to the chamber. Holes 68 and 70 are angled at about 10 degrees toward the directional line and the angle controls the distance of focus along the directional line which is in the plane of hole 68 and 70, as well as the second pair of holes 72 and 74. Chamber 48 is attached to arm 66 of bracket 22 with bolts 78 and 80. The arrows indicate air flow through hole 76 into chamber 64 and out through the four holes all pointed to focus points along the directional line. In FIG. 9, the shape of chamber 64 is visible with hole 72 opening at a 90 degree angle to face 40, it being on the plane of the directional line.

While this invention has been described with reference to the specific embodiments disclosed herein, it is not confined to the details set forth and the patent is intended to include modifications and changes which may come within and extend from the following claims.

I claim:

1. A string positioning device to position a free end of a string in alignment with a directional line not enclosed sufficiently to significantly affect air flow directed along the line, the device comprising:

(a) a string holding means to hold the string with the free end of the string positioned proximate the directional line, and (b) a string end positioning means comprising:

(i) a head member having a wall facing perpendicular to the directional line, (ii) a plurality of holes through the wall spaced apart from each other, and (iii) a compressed air supply means to supply compressed air to the head member to flow outwardly through the holes, wherein the holes are spaced sufficiently apart and the holes are angled sufficiently into the wall to cause the air flow out of the holes to focus at at least one point on the directional line to catch and hold a length of the free end in alignment along the directional line.

2. The device of claim 1 wherein the holes are in a plane containing the directional line.

3. The device of claim 1 wherein the holes are spaced apart in pairs, the holes of each pair being equidistant from the directional line.

4. The device of claim 1 wherein there are no holes on the directional line.

5. The device of claim 1 wherein there is a plurality of pairs of holes and the holes of the pair of holes closest to the directional line are of a smaller diameter than a pair of holes further from the directional line.

6. The device of claim 1 wherein the head member further comprises an air source opening into the head member through which the supply of compressed air flows to the head member, and the combined area of the holes is smaller than the cross-sectional area of the air source opening.

7. The device of claim 1 wherein the wall has two to six holes grouped apart in equal numbers on each side of the directional line.

8. The device of claim 1 wherein the holes are angled such that lines drawn through a central axis of the holes focus about two to about four inches from the wall along the directional line.

9. A string attaching device to attach a string to a body having a round convex surface, the device comprising:

(a) rotating means to contact and rotate the body, (b) body holding means to hold the body with a portion of the round convex surface facing the rotating means, (c) a string holding means to hold the string with a free end of the string positioned proximate the body, and (d) a string end positioning means for positioning the string in alignment with a directional line, comprising:

(i) a head member having a wall facing the round convex surface and perpendicular to the directional line, (ii) a plurality of holes through the wall spaced apart from each other, and (iii) a compressed air supply means to supply compressed air to the head member to flow outwardly through the holes, wherein the holes are spaced sufficiently apart and the holes are angled sufficiently into the wall to cause the air flow out of the holes to focus at at least one point proximate the round convex surface on the directional line which extends between the round convex surface and the rotating means, to catch and hold a length of the free end in alignment along the directional line, wherein the the directional line is not enclosed sufficiently to significantly affect air flow directed along the line and wherein said string is attached to said body by contacting and being wound onto said body.

10. The device of claim 9 wherein the holes are in a plane containing the directional line.

11. The device of claim 9 wherein the holes are spaced apart in pairs, the holes of each pair being equidistant from the directional line.

12. The device of claim 9 wherein there are no holes on the directional line.

13. The device of claim 9 wherein the wall has two to six holes grouped apart in equal numbers on each side of the directional line.

14. The device of claim 9 wherein the body is a sphere and the round convex surface is a spherical surface.

15. The device of claim 9 wherein the holding means comprises a pair of freely rotating concave rollers.

16. In a ball winding apparatus having at least one winding station at which string is wound around a core, the station including support means to hold the core during the winding and rotating means to contact and rotate the core and the winding ball, a string attaching device comprising:

(a) a string holding means to hold the string with a free end of the string positioned proximate the core, and (b) a string end positioning means comprising:

(i) a head member having a wall facing perpendicular to a directional line passing between the core and the rotating means, wherein the line is not enclosed sufficiently to significantly affect air flow directed along the line, (ii) a plurality of holes through the wall spaced apart from each other, and (iii) a compressed air supply means to supply compressed air to the head member to flow outwardly through the holes, wherein the holes are spaced sufficiently apart and the holes are angled sufficiently into the wall to cause the air flow out of the holes to focus at at least one point proximate the core on the directional line to catch and hold a length of the free end in alignment along the directional line and wherein said string is attached to said body by contacting and being wound onto said body.

17. The device of claim 16 wherein the holes are in a plane containing the directional line.

18. The device of claim 16 wherein the holes are spaced apart in pairs, the holes of each pair equidistant from the directional line.

19. The device of claim 16 wherein there are no holes on the directional line.

20. The device of claim 16 wherein the the holes are angled such that lines drawn through the central axis of the holes converge about two to about four inches from the head.

21. A method of positioning string along a directional line not enclosed sufficiently to significantly affect air flow directed along the line proximate to a surface comprising:

(a) holding the string with a free end of the string positioned proximate the surface, (b) providing at least one head member having a wall facing perpendicular to the directional line, (c) placing a plurality of holes spaced apart from each other in the wall, (d) flowing compressed air to the wall to flow outwardly through the holes, wherein the holes are spaced sufficiently apart and the holes are angled sufficiently into the face member to cause the air flow out of the holes to focus at at least one point on the directional line, and (e) catching and holding with the air flow a length of the free end of the string along the directional line.

22. The method of claim 21 wherein the surface is a round convex surface.

23. The method of claim 21 wherein the surface is a spherical surface.

24. A method of attaching string to a body having a round convex surface comprising:

(a) providing rotating means to rotate the body by contact with the round convex surface, (b) holding the body with the round convex surface facing the rotating means while exposing a top of the body, (c) holding a free end of the string proximate the body, (d) providing a string end positioning means comprising:

(i) at least one head member, and (ii) a plurality of holes spaced apart from each other in the head member, (e) blowing air outwardly through the holes, (f) positioning the head member and the holes, and angling the holes sufficiently into the head member to cause the air flow out of the holes to focus at at least one point along a directional line which extends between the body and the head member and is not enclosed sufficiently to significantly affect air flow directed along the line to hold a length of the free end of the string close to the top of the body, (g) moving the top of the body against the rotating means catching the length of the string end between the body and the rotating means, and (h) rotating the rotating means to wind the string around the body.

* * * * *